US010724190B1

(12) United States Patent
Majdalawi et al.

(10) Patent No.: US 10,724,190 B1
(45) Date of Patent: Jul. 28, 2020

(54) SOLAR POWERED IN-ROAD LAMP

(71) Applicants: Wael Majdalawi, Delray Beach, FL (US); Bertho Boman, Ft. Lauderdale, FL (US)

(72) Inventors: Wael Majdalawi, Delray Beach, FL (US); Bertho Boman, Ft. Lauderdale, FL (US)

( * ) Notice: Subject to any disclaimer, the term of this patent is extended or adjusted under 35 U.S.C. 154(b) by 0 days.

(21) Appl. No.: 15/932,754

(22) Filed: Apr. 18, 2018

Related U.S. Application Data

(63) Continuation-in-part of application No. 14/545,120, filed on Mar. 27, 2015, now abandoned.

(51) Int. Cl.

| | |
|---|---|
| ***F21S 9/03*** | (2006.01) |
| ***E01F 9/559*** | (2016.01) |
| ***F21S 8/02*** | (2006.01) |
| ***F21V 21/04*** | (2006.01) |
| ***F21V 3/00*** | (2015.01) |
| *F21W 111/02* | (2006.01) |

(52) U.S. Cl.
CPC ..... *E01F 9/559* (2016.02); *F21S 8/022* (2013.01); *F21S 9/037* (2013.01); *F21V 3/00* (2013.01); *F21V 21/04* (2013.01); *F21W 2111/02* (2013.01)

(58) Field of Classification Search
CPC . E01F 9/559; F21S 8/022; F21S 9/037; F21V 3/00; F21V 21/04
See application file for complete search history.

(56) References Cited

U.S. PATENT DOCUMENTS

| | | | | |
|---|---|---|---|---|
| 5,984,570 | A * | 11/1999 | Parashar | E01F 9/559 362/153.1 |
| 6,210,017 | B1 * | 4/2001 | Miura | F21S 8/022 362/153 |
| 7,088,222 | B1 * | 8/2006 | Dueker | B60Q 7/00 340/321 |
| 9,699,844 | B2 * | 7/2017 | Xu | H05B 33/0815 |
| 2003/0090876 | A1 * | 5/2003 | Groppfeldt | H01L 23/3128 361/715 |
| 2004/0252489 | A1 * | 12/2004 | Hagen | F21S 8/022 362/153.1 |
| 2006/0231131 | A1 * | 10/2006 | Hain | E01C 17/00 136/244 |

(Continued)

*Primary Examiner* — Anabel Ton
(74) *Attorney, Agent, or Firm* — Frank L. Kubler

(57) ABSTRACT

A solar powered road lamp apparatus includes a mounting cup for embedding in a recess in a mounting surface; a light assembly removably fitted within the mounting cup, the light assembly including a power source and a light source connected to the power source so that the light source emits light over the mounting surface, and a solar cell structure connected to the power source for recharging the power source. The cup preferably is formed of plastic or biodegradable material. The framework preferably includes a top structure having a light directing channel, adjacent to the light source for directing light from the light source through the framework and over the mounting surface, and a solar cell exposure port above the solar cell, a base plate spaced below the top structure, and at least one bolt interconnecting the top structure and the base plate. The apparatus preferably additionally includes a translucent or transparent core structure clamped between the top structure and the base plate.

20 Claims, 5 Drawing Sheets

(56) References Cited

U.S. PATENT DOCUMENTS

| | | | | |
|---|---|---|---|---|
| 2007/0263381 | A1* | 11/2007 | Goldman | F21S 9/032<br>362/183 |
| 2015/0029040 | A1* | 1/2015 | McDowell | E01C 9/08<br>340/907 |
| 2016/0025287 | A1* | 1/2016 | Philhower | F21S 9/037<br>362/183 |
| 2019/0069379 | A1* | 2/2019 | Kastee | H05B 33/0854 |

* cited by examiner

SOLAR POWERED IN-ROAD LAMP

FILING HISTORY

This application is a continuation-in-part of application Ser. No. 14/545,120, filed on Mar. 27, 2015.

BACKGROUND OF THE INVENTION

1. Field of the Invention

The present invention relates generally to the field of road marking devices. More specifically the present invention relates to a solar powered lamp for embedding in a road surface and emitting various colors of light, either continuously or in pulses, to communicate information such as the location of the edge of the road or altered traffic direction without producing back light. The lamp is configured to withstand the forces of repeated snow plow impact while emitting a discrete beam of light directed toward approaching motor vehicle drivers. The color of light emitted, as well as whether it is pulsing or steady, or disabled (turned off) can be changed remotely with an RF signal. The light assembly fits into a biodegradable plastic mounting cup embedded in a road surface, and can be readily removed from the cup with a special tool when if replacement is needed. The cup never has to be pried out of the road when the road is resurfaced, because it can be consumed 2 during milling of the road without damage to the milling machine and a new cup one installed by drilling a hole in the asphalt and embedding another cup and then reinstalling the lamp module. The solar powered road lamp apparatus includes a lamp assembly removably fitted into the mounting cup which is secured within a recess in a mounting surface. The lamp assembly preferably includes a lamp assembly framework having the structural strength to absorb undamaged and transmit to the mounting surface the impact and weight of a moving motor vehicle rolling over the apparatus. The framework contains a solar cell structure and a rechargeable power source electrically connected to a light source electrically through a control circuit in the form of a controller board. The controller board also contains an optional RF transceiver for remote control and communication.

The framework includes a framework top structure having at least one and preferably two light directing channels in diametrically opposing directions, each channel angling upwardly and extending radially outwardly from its corresponding light source within the framework top structure to release light from the given light source toward approaching motor vehicles as the vehicle reaches a certain pre-determined distance from the apparatus. Thus, beams of light can be directed over a road in both directions of vehicle travel. The framework top structure further includes at least one and preferably two solar cell exposure ports opening upwardly through the top of the framework structure for admitting sunlight to the two corresponding solar cell structures respectively positioned directly below each cell exposure port.

The framework top structure preferably takes the form of a plate, and the framework additionally includes a framework base plate spaced downward from the framework top structure and includes at least one and preferably four upright and laterally spaced apart framework bolts extending upwardly through bolt ports in the base plate into registering tubular threaded bolt passageways in the lower surface of the top structure. The framework top structure preferably has a beveled peripheral surface around and along its upper edge to deflect and withstand the impact of snow plow blades. The framework preferably is made of cast iron for strength and durability in roads where the apparatus will be subjected to snow plow blade impacts, and for other roads preferably is made of cast aluminum, except for the framework bolts which are made of steel.

A monolithic light passing core structure, made as a single piece, which is either translucent or transparent, is configured to fit upwardly against and into the lower surfaces of the framework top structure, so that the elements of the core structure effectively mesh with the elements of the top structure. The core structure preferably includes a specially configured core top wall and a core side wall extending downwardly from the periphery of the core top wall. The core side wall outer surface includes a circumferential O-ring groove into which an O-ring is seated, to releasibly anchor the lamp assembly within the mounting cup with friction and to seal the opening.

The core top wall includes core bolt ports for passing the framework top portion tubular bolt passageways. Portions of the core structure take the form of elevated and substantially planar areas which are sized and positioned to function as solar light windows which fit snugly up through the light passing solar cell exposure ports, respectively, in the top structure, while the areas of the core structure immediately surrounding the solar cell exposure ports abut and seal against the lower surface of the framework top structure to prevent moisture from entering the light assembly.

Other portions of the core structure in the form of elevated ribs are sized and positioned to fit into light directing channels, respectively, in the framework top structure to conduct light from the two light sources through the channels and out of the light assembly. At the same time, ribs create seals to prevent the entry of moisture into the assembly through the channels. As noted, the entire core is one piece, and fitted within the top structure and clamped and sealed with base plate to create a sealed unit that prevents moisture from entering the light assembly. Each light source preferably is an LED bar.

The light directing channel is oriented within the housing top wall beveled peripheral surface so that it directs a beam of light from the light source at an acute angle from the road surface directly toward an on-coming driver. The housing top portion preferably includes two light source covers at in diametrically opposed locations along the top wall beveled peripheral surface, so that beams of light can be directed over a road in both directions of vehicle travel.

The acute angle of each light directing channel preferably is selected to align the emitted beam of light with the average eye level of an on-coming driver at a selected distance from the lamp which gives the driver adequate reaction time at a given vehicle speed. This top wall beveled peripheral surface, light directing channel and light source cover configurations are key features of the present invention and synergistically combine to produce the structural durability to withstand many snowplow impacts without damage or significant wear with an optimally directed discrete beam of emitted light without creating any backlight.

2. Description of the Prior Art

There have long been reflectors mounted in roads to reflect light from vehicle headlights or from the sun to perform a marking function such as to mark the centerline of the road. In more recent years road lamps have been developed which are embedded into the surfaces of roads, such as in cut out mounting holes in a road surface, to radiate light from an electrically powered light source. Examples of these prior road lamps include the INFINITY, INC.™ YH-DDI and the TOPSAFE™ TP-SR-9.

A problem with these prior road lamps is that they are easily damaged and ultimately destroyed by contact with snow plows, so that the use of lighted road lamps has been largely restricted to geographical areas where snow plows are not used. Another problem is back lighting, resulting from lamp top portions being translucent so that light emitted by a light source through a prior art lamp top portion is conducted throughout the top portion, resulting in a dimly glowing lamp rather than a bright and distinct beam of light selectively directed toward approaching vehicle drivers. This light leakage and conduction throughout the lamp top portion also makes the use of different colored lights in a single road lamp unworkable, because the different colors merge and blend into a single, combined color. Still another problem is that these prior road lamps are easily dislodged from roads into which they are embedded because they generally have a downwardly tapering, inverted frusto-conical shape.

Another shortcoming of prior road lamps is that they are costly and time consuming to remove when they no long function, or when the road surface needs to be milled. Some prior road lamps have to disassembled and removed piece by piece, and the metal outer housing pried out of the road. Roads normally have to be milled once every ten years. Yet at the same time, some can be disassembled simply by removing screws from the top, so that they can be readily stolen.

It is thus an object of the present invention to provide a solar powered marking and signaling lamp for embedding in a road which is configured and structured so that the lamp is not significantly damaged by contact with snow plows, such structure including beveling of the upper peripheral edge to deflect snow plow blades and a low profile of perhaps 5 milimeters protruding upwardly from the road surface to direct emitted light. And a structure that allows heavy trucks to drive over it without any damage.

It is another object of the present invention to provide such a lamp which produces no back lighting such as from light diffusing into a translucent lamp housing, so that a light beam emitted by the lamp is discrete, isolated and selectively directed and does conduct through the housing and does not mix with any other light emitted by the lamp.

It is still another object of the present invention to provide such a lamp which includes a power source which can be discharged and recharged many, many times before it wears out, thereby giving the lamp a long service life.

It is yet another object of the present invention to provide such a lamp which can be remotely operated by a radio frequency transmitter so that either a single or multiple such lamps can be caused to change the color of the light they radiate or can be caused to radiate light either continuously or in pulses.

It is still an additional object of the present invention to provide such a lamp which includes a light assembly removably fitted into a biodegradable mounting cup embedded in a road, such that the light assembly can be readily and quickly removed from the cup when it is in need of repair, and the light assembly can be readily replaced with another light assembly, and the mounting cup can be left in the road when the time comes to mill the road surface, and destroyed by a milling machine without harm to the machine, saving the time and cost of removal.

It is a still further object of the present invention to provide such a lamp in which the light assembly can be removed from the mounting cup easily and quickly with a special tool, but otherwise is extremely difficult to remove from the cup, so that the light assembly is not subject to theft.

It is a yet further object of the present invention to provide such a lamp in which the light assembly core structure and the mounting cup are both made of similar materials, such as polycarbonate plastic, and which are separated by an O-ring, so that movement of one relative to the other does not cause significant wear. Its function is also to seal the opening to prevent liquid getting not the cup and to prevent liquid from getting out when the lamp unit is removed by hydraulic pressure.

It is an additional object of the invention to provide such a lamp incorporating a translucent or transparent core into which internal components are mounted, which is formed as a single monolithic piece to prevent entry of moisture.

It is a still additional object of the present invention to provide a secondary means of lifting the light assembly from engagement with the mounting cup hydraulically using water delivered underneath the light assembly within the cup.

It is a yet additional object of the present invention to provide a means in the form of a dowel projecting upwardly from the mounting cup bottom wall into the light assembly to prevent the light assembly from rotating out of position within the mounting cup It is finally an object of the present invention to provide such a lamp which is not easily dislodged from a road and which is sturdy, easy to install, reliable and economical to manufacture.

Programmability and light communication is an important feature that is new and very useful for testing, maintenance, and manufacturing.

SUMMARY OF THE INVENTION

The present invention accomplishes the above-stated objectives, as well as others, as may be determined by a fair reading and interpretation of the entire specification.

A solar powered road lamp apparatus is provided, including a mounting cup having a cup bottom wall and a cup side wall for embedding in a recess in a mounting surface; a light assembly removable fitted within the mounting cup, the light assembly including a power source and a light source connected to the power source so that the light source emits light over the mounting surface, and a solar cell structure connected to the power source for recharging the power source.

The mounting cup preferably is formed of plastic or of a biodegradable material. The mounting cup preferably additionally includes a cup lip extending laterally from the cup side wall. The framework preferably includes a top structure having a light directing channel, adjacent to the light source for directing light from the light source through the framework and over the mounting surface, and a solar cell exposure port above the solar cell, a base plate spaced below the top structure, and at least one bolt interconnecting the top structure and the base plate.

The apparatus preferably additionally includes a core structure that is one of translucent and transparent for placement below and in abutting contact with the top structure, the core structure having a core top wall and a core side wall extending downwardly from the core top wall, and light source and structure. The mounting cup is embedded above the rebar within concrete bridges, and this permits ease of placing the unit and ease of the future replacement. Previous road lamps when embedded would extend more deeply into the concrete and therefore be too close to the concrete rebar, preventing the installation and future replacement of such prior lamps in bridges.

It is additionally noted that the circuitry in the present light assembly preferably includes microprocessor or other means for programming the unit externally and wirelessly and to provide the opportunity to communicate wirelessly with the unit and to externally operate the program and receive a status report sent from the apparatus to a remote location such as a central operating station.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
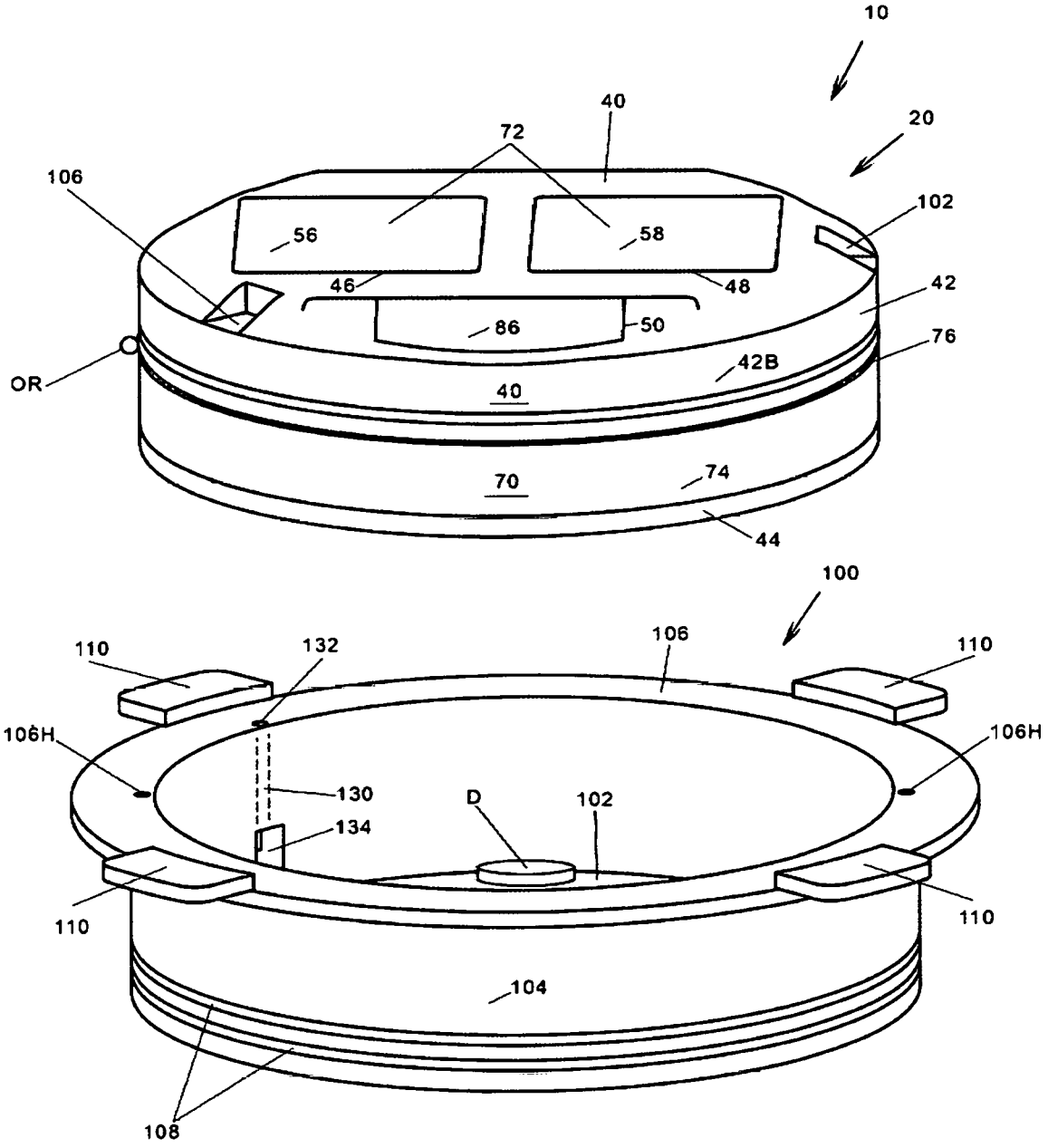
FIG. 1 is a perspective view the apparatus with the light assembly shown elevated above the mounting cup.

As required, detailed embodiments of the present invention are disclosed herein; however, it is to be understood that the disclosed embodiments are merely exemplary of the invention which may be embodied in various forms. Therefore, specific structural and functional detailed disclosed herein are not to be interpreted as limiting, but merely a basis for the claims and as a representative basis for teaching one skilled in the art to variously employ the present invention in virtually any appropriately detailed structure. Reference is now made to the drawings, wherein like characteristics and features of the present invention shown in the various FIGURES are designated by the same reference numerals.

First Preferred Embodiment

Figure 2:
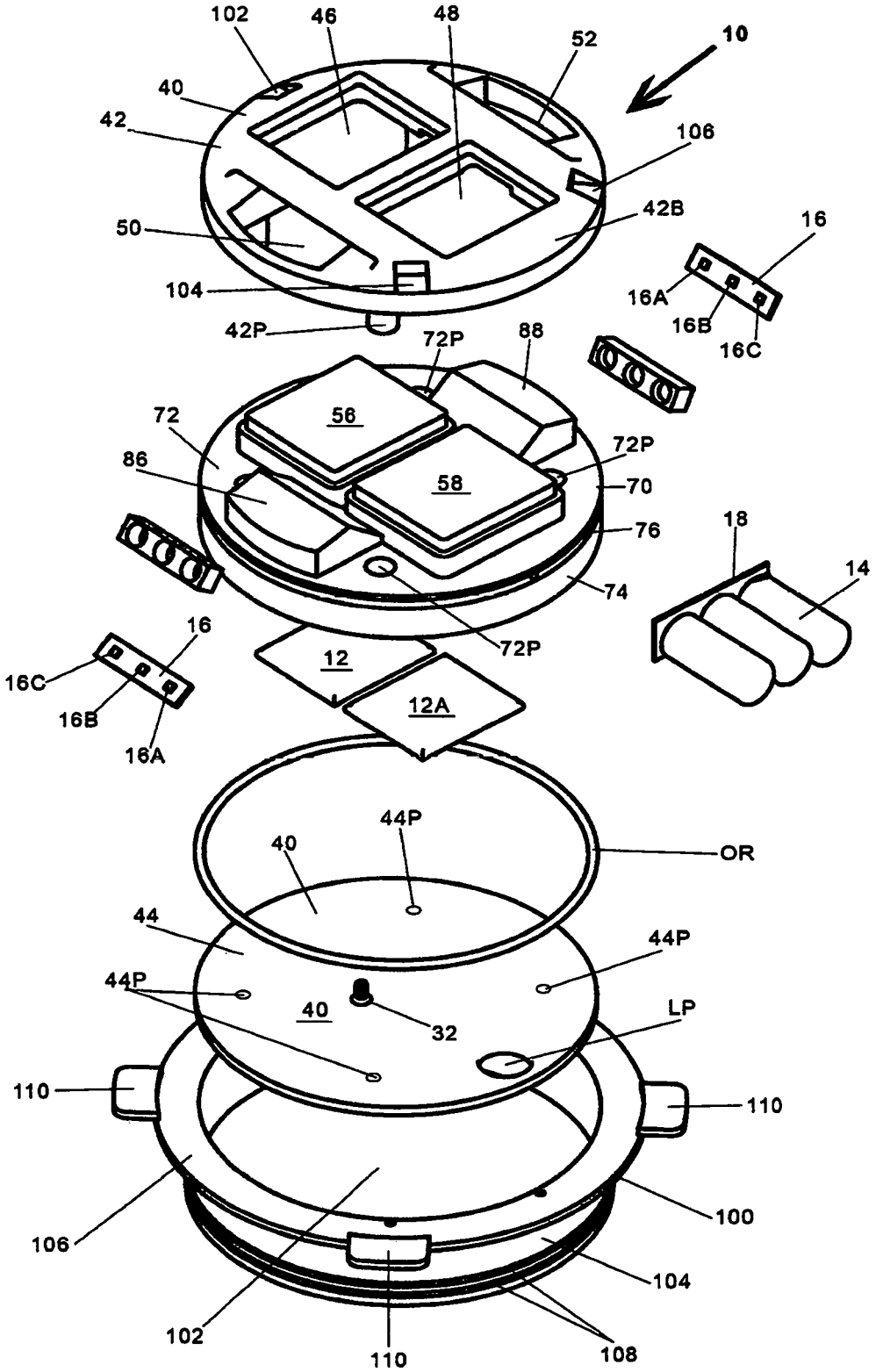
FIG. 2 is an exploded view of the apparatus of FIG. 1.
Figure 4:
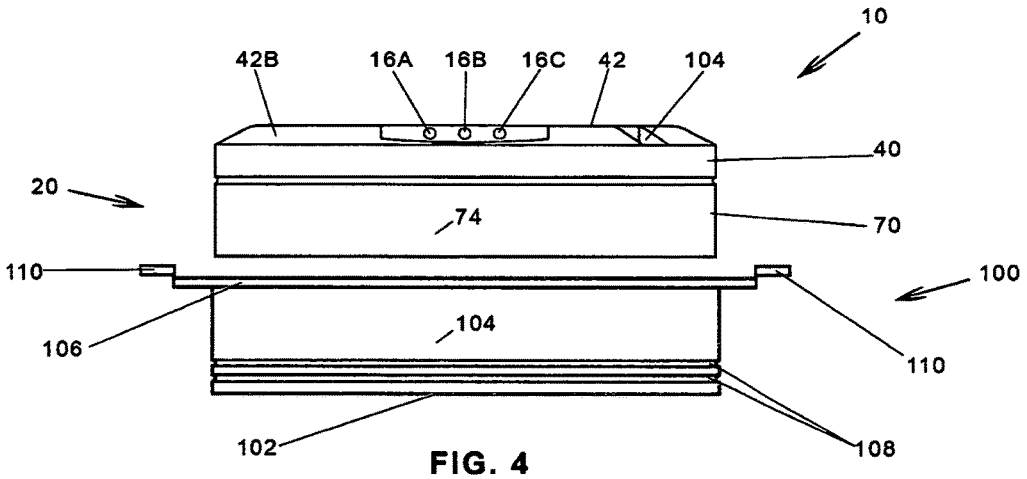
FIG. 4 is a side plan view of the apparatus as in FIG. 1, with the light assembly elevated above and positioned for insertion into the mounting cup.
Figure 3:
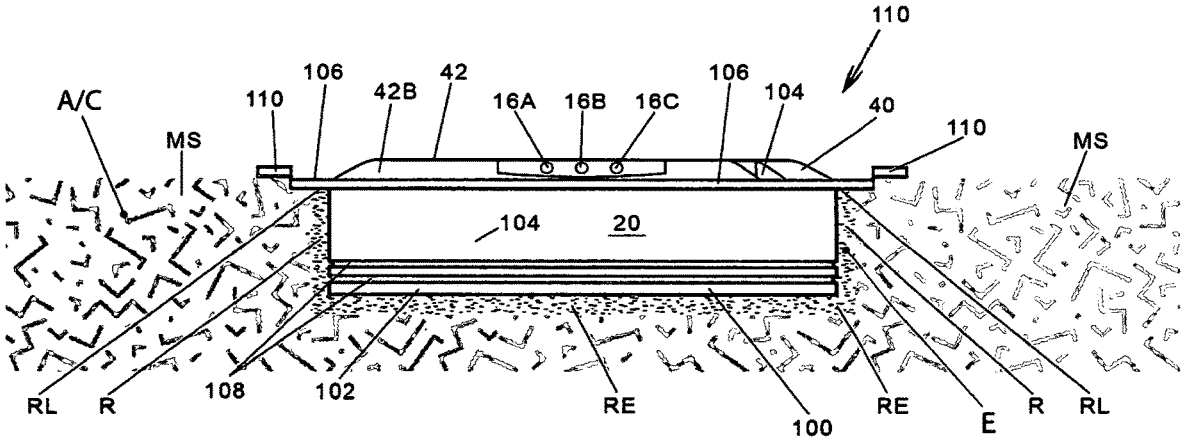
FIG. 3 is a cross-sectional side view of a road, showing the hole containing the apparatus.
Figure 5:
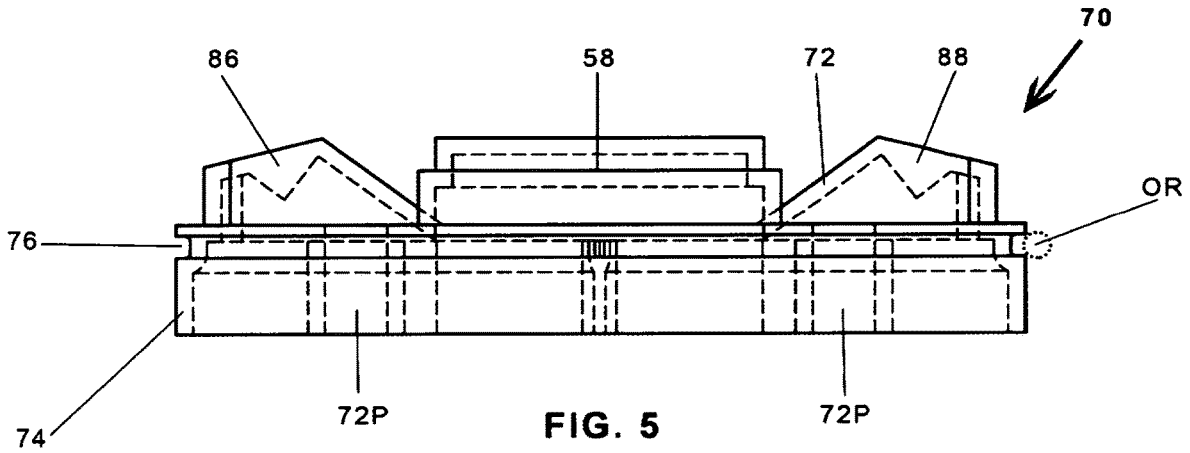
FIG. 5 is a side plan view of the core structure, with hidden structures shown n broken lines.
Figure 6:
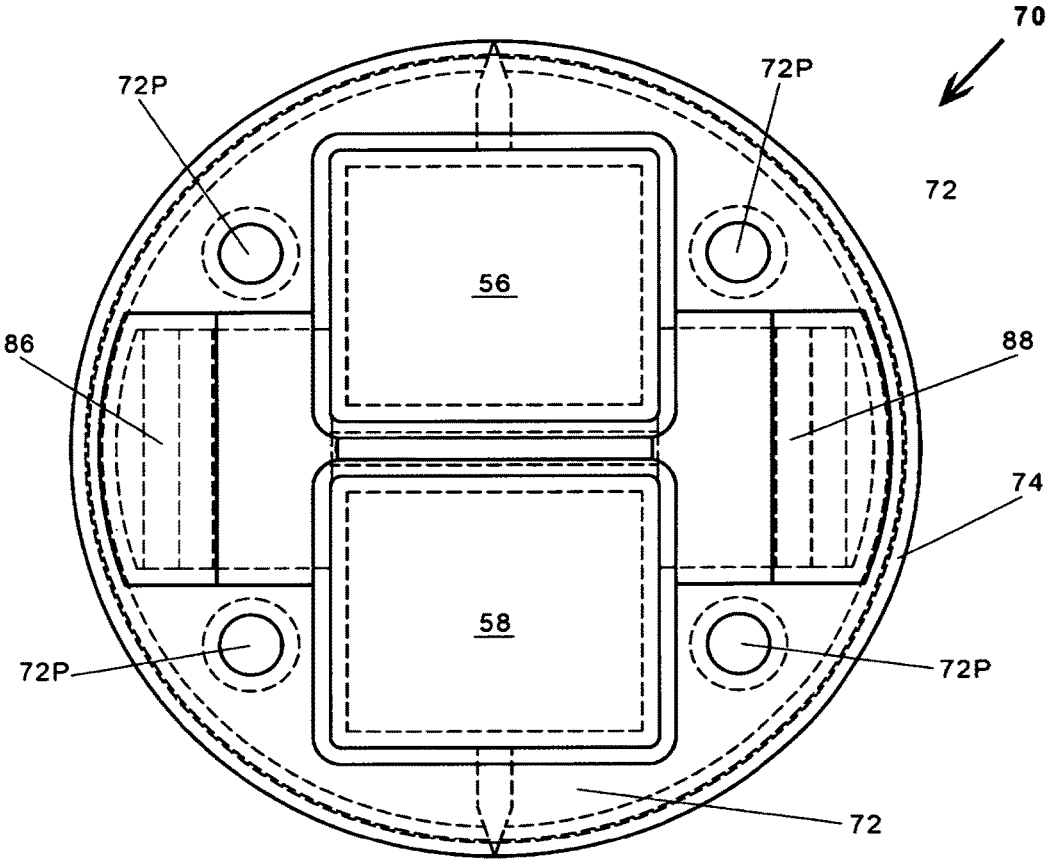
FIG. 6 is a top plan view of the core structure of FIG. 5.
Figure 7:
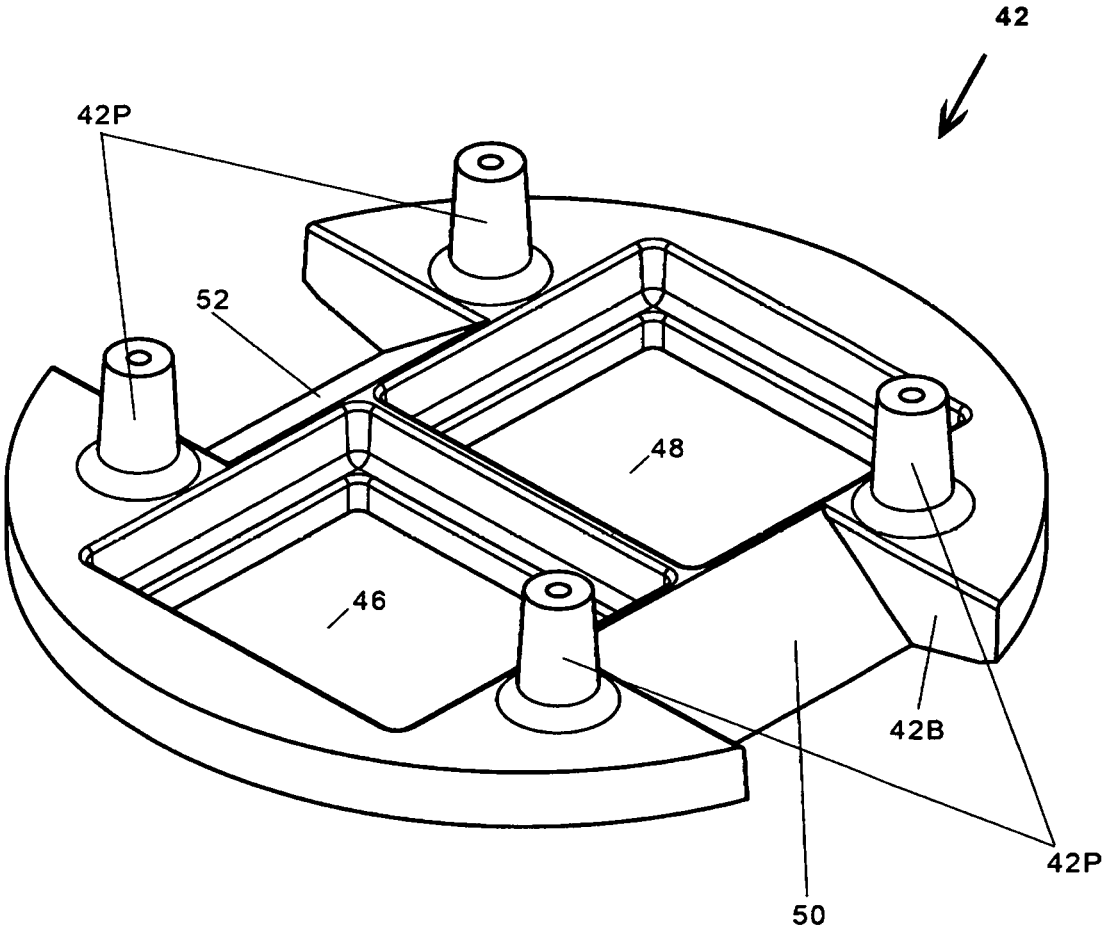
FIG. 7 is a perspective bottom view of the framework top structure.

Referring to FIGS. 1-7, a solar powered road lamp apparatus 10 is disclosed including a lamp assembly 20 removably fitted into a mounting cup 100 which is secured within a recess R in a mounting surface MS such as a road. The lamp assembly 20 preferably includes a lamp assembly framework 40 having the structural strength to absorb undamaged and transmit to the mounting surface MS the impact and weight of a moving motor vehicle rolling over the apparatus 10. The framework 40 contains a solar cell structure 12 and a rechargeable power source 14 electrically connected to a light source 16 electrically through a control circuit in the form of a controller board 18. The controller board also contains an optional RF transceiver for remote control and communication.

The framework 40 includes a framework top structure 42 having at least one and preferably two light directing channels 50 and 52 in diametrically opposing directions, each channel 50 and 52 angling upwardly and extending radially outwardly from its corresponding light source 16 within the framework top structure 42 to release light from the given light source 16 toward approaching motor vehicles as the vehicle reaches a certain pre-determined distance from the apparatus 10. Thus, beams of light can be directed over a road in both directions of vehicle travel. The framework top structure 42 further includes at least one and preferably two solar cell exposure ports 46 and 48 opening upwardly through the top of, the framework structure 42 for admitting sunlight to the two corresponding solar cell structures 12 and 12A respectively positioned directly below each cell exposure port 46 and 48.

The framework top structure 42 preferably takes the form of a plate, and the framework 10 40 additionally includes a framework base plate 44 spaced downward from the framework top structure 42 and includes at least one and preferably four upright and laterally spaced apart framework bolts 32 extending upwardly through bolt ports 44P in the base plate 44 into registering tubular threaded bolt passageways 42P in the lower surface of the top structure 42.

The framework top structure 42 preferably has a beveled peripheral surface 42B around and along its upper edge to deflect and withstand the impact of snow plow blades. The framework 40 preferably is made of cast iron for strength and durability in roads where the apparatus 10 will be subjected to snow plow blade impacts, and for other roads preferably is made of cast aluminum, except for the framework bolts 32 which are made of steel.

A monolithic light passing core structure 70, made as a single piece, which is either translucent or transparent, is configured to fit upwardly against and into the lower surfaces of the framework top structure 42, such that the elements of the core structure 70 effectively mesh with the elements of the top structure 42. The core structure 70 preferably includes a specially configured core top wall 72 and a core side wall 74 extending downwardly from the periphery of the core top wall 72. The core side wall 74 outer surface includes a circumferential O-ring yoove 76 into which an O-ring OR is seated, to releasibly anchor the lamp assembly 20 within the mounting cup 100 with friction and to seal the opening.

The core top wall includes core bolt ports 72P for passing the framework top portion tubular bolt passageways 42P. Portions of the core structure 70 take the form of elevated and substantially planar areas which are sized and positioned to function as solar light windows 56 and 58 which fit snugly up through the light passing solar cell exposure ports 46 and 48, respectively, in the top structure 42, while the areas of the core structure 70 immediately surrounding the solar cell exposure ports 46 and 48 abut and seal against the lower surface of the framework top structure 42 to prevent moisture from entering the light assembly 20.

Other portions of the core structure 70 in the form of elevated ribs 86 and 88 are sized and positioned to fit into light directing channels 50 and 52, respectively, in the framework top structure 42 to conduct light from the two light sources 16 through the channels 50 and 52 and out of the light assembly 20. At the same time, ribs 86 and 88 create seals to prevent the entry of moisture into the assembly 20 through the channels 50 and 52. As noted, the entire core 70 is one piece, and fitted within the top structure 42 and clamped and sealed with base plate 44 to create a sealed unit that prevents moisture from entering the light assembly 20.

Each light source 16 preferably is an LED PCB bar into which one or more three LED's 16A, 16B and 16C and are fixedly mounted. Each LED PCB bar 16 is placed adjacent to or in abutting relation with the inward end of a corresponding light directing channel 50 or 52 or rib 86 or 88 wedged or otherwise snugly fitted inside a light directing channel 50 or 52.

The mounting cup 100 includes a cup bottom wall 102 and a cup side wall 104 having an outwardly protruding cup lip 106 at its upper end. The outer surface of the cup side wall 104 preferably includes least one and preferably two circumferential resin receiving grooves 108. A recess in the form of a cylindrical hole R is drilled into the road surface MS with a countersunk lip receiving recess RL around its periphery, and a two-part epoxy resin is placed in the hole R. Then the cup 100 is pressed downward into the hole R until the lip 106 is seated within the lip receiving recess RL and is therefore flush with the road surface. Optional break-off leveling tabs 110 protrude radially outward from the upper surface of the cup lip 106 to rest on the upper surface of the road. Resin RE injected into the hole R flows upwardly around the cup side wall 104 and into the resin receiving grooves 108 as the mounting cup 100 is inserted into the hole R to better anchor the cup 100.

An additional or alternative feature to the three-prong removal tool (not shown) for aiding in dislodging and lifting a light assembly 20 out of the cup 100. There is a water delivery passageway 130. The water delivery passageway 130 as an upper passageway receiving port 132 in the upper surface of the cup side wall 104 and passes downwardly through the cup side wall 104, opening out of the inward surface of the cup side wall 104 through a passageway discharge port 134 located just above the cup bottom wall 102. See FIG. 1. The passageway discharge port 134 preferably opens in an outwardly expanding configuration. To dislodge and elevate the light assembly 20 within the cup 100, water is delivered under pressure into the water receiving port 132, which passes downwardly through the water delivery passageway 130 and out of the passageway discharge port 134, where it collects between the bottom of the light assembly 20 and the cup bottom wall 102. The O-ring OR seals the water within this space. Continued delivery of water below the lighting assembly 20 creates hydraulic pressure, lifting the light assembly 20 upwardly within the cup 100 so that the light assembly 20 can be easily removed.

The mounting cup 100 is formed of a biodegradable plastic so when the road is to be milled, the light assembly 20 can be removed from the cup 100 and the milling machine blade simply cuts through and destroys the cup 100 without damage to the machine. As a result, no time-consuming and costly effort to pry the road lights out of the road has to be performed prior to milling the road. This is another key feature of the present invention. A special light assembly three-prong removal tool (not shown) is provided which engages tool notches 102, 104 and 106 in the periphery of the framework top structure 42. See FIGS. 1 and 2.

The light passing ribs 86 and 88 preferably each have an outer surface which is Beveled \ to match and become flush and continuous with the bevel of the beveled peripheral surface 42B of the top structure 42 when the light transmitting rib 86 or 88 is fitted into the light directing 10 channel 50 or 52.

The acute angle of each light directing channel 44 preferably is selected to align the emitted beam of light with the average eye level of an on-coming driver at a selected distance from the lamp 10 which gives the driver adequate reaction time at a given vehicle speed. This top wall beveled peripheral surface 42B, light directing channel 50 or 52 and rib 86 or 88 configurations are key features of the present invention and synergistically combine to produce the structural durability to withstand many snowplow impacts without damage or significant wear with an optimally directed discrete beam of emitted light without creating any backlight.

Each light source rib 86 and 88 preferably is a solid, transparent block such as of polycarbonate which is securely mounted in a light directing channel 44 in the housing top wall 42 when the core 70 is mounted against the top structure 42. The light source ribs 86 and 88 optionally include light diffusing features. The preferred light source 16 is at least one light emitting diode (LED) 16 oriented to radiate light toward and through the corresponding light directing channel 50 or 52.

The power source 14 preferably includes at least one and preferably two ultra-capacitors 14, because they hold sufficient charge to power the light source 16 and thus to operate the lamp 10 through typical night hours before being recharged by day by the solar cell assembly 12 Ultracapacitors 14 are preferred over most types of batteries because they can be recharged a great many times and thus give the present lamp 10 a long life. Alternatively, in place of ultracapacitors 14, the power source 14 may include suitable long life lithium batteries (not shown).

The controller board 18 preferably is fitted loosely within the framework 40 and is anchored in place by potting material thereafter placed within the framework 40. The controller board 18 preferably includes means for receiving an RF (radio frequency) signal which is coded to alter as desired the color of light emitted by the LED's 16 and 16A as well as select steady light emission versus pulsed light emission or disabling the light, for sending drivers different signals communicating different meanings. The controller board 18 preferably used with RF to produce changes in LED 16 color and changes between steady and pulsing light is the MPU-Model. See FIG. 2. A preferred type of LED 16A, 16B and 16C for producing more than one color of light is known as an RGB, which as the name suggests can produce red, green or blue light. Optionally there is also an RF transmitter for providing status or communication networks.

The controller board also has the option to digitally communicate via light pulses from the internal LEDs and receiving information through the solar panels. This construction permits the present apparatus 10 to be shorter and thus extend a shorter depth into a mounting surface, such as 1.5 inches. As a result, apparatus 10 can be embedded in concrete bridges having rebar at a depth of 2.5 inches.

Where no color change is desired and RF is not provided, the controller board 18 preferably is the 6-Model. The LED can be one of many known types that produce only a single color, and can be either flashing or steady with most popular colors, such as white, yellow and red.

The framework top structure 42 preferably further includes a rotational locking dowel D extending downwardly from and near the periphery of the top structure 42. This locking dowel D is positioned to fit within a corresponding rotational locking port LP in the base plate 44 to lock the top structure 42 against rotation relative to the base plate 44 and thus to the road, so that the light directing channel or channels 50 and 52 cannot shift out of their optimum positions over time.

The interior of the light assembly 20 preferably is filled with potting material PM to seal electrical components.

As noted above, the mounting cup 100 is sealed and anchored into its mounting hole R by an adhesive in the form of the resin RE poured into the mounting hole R prior to insertion of the mounting cup 100 into the hole R. The resin RE flows from under the cup bottom wall 102 up and around the cup side wall 104 and into the resin receiving grooves 108 as the cup 100 is fitted into the hole R. The resin RE then hardens and bonds with the cup 100 and the surrounding road material.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim as our invention:

1. A solar powered road lamp apparatus, comprising:

a mounting cup having a cup bottom wall and a cup side wall for embedding in a recess in a mounting surface;

and a light assembly removably fitted within said mounting cup, said light assembly comprising a power source and a light source connected to said power source, and a solar cell structure connected to said power source for recharging said power source, and a light assembly framework comprising a framework top structure having at least one light directing channel for emitting and directing light over the mounting surface, and a solar cell exposure port above said solar cell for passing sunlight through said framework top structure to said solar cell, a framework base plate spaced below said framework top structure, and at least one framework interconnection structure extending between said framework top structure and said framework base plate, interconnecting said framework top structure and said framework base plate, said light assembly framework providing structural strength to said light assembly to bear the weight of a motor vehicle.

2. The apparatus of claim 1, wherein said at least one framework interconnecting structure comprises a tubular bolt passageway extending between said framework top structure and said framework base plate and a framework bolt passing through said tubular bolt passageway and interconnecting said framework top structure and said framework base plate.

3. The apparatus of claim 2, comprising a plurality of said tubular bolt passageways extending between said framework top structure and said framework base plate and a framework bolt passing through each said tubular bolt passageway interconnecting said framework top structure and said framework base plate.

4. The apparatus of claim 1, additionally comprising a core structure which is one of translucent and transparent extending between and in substantially abutting contact with both of said framework top structure and said framework base plate, wherein said light source and said power source and said solar cell structure are seated within said core structure.

5. The apparatus of claim 4, wherein said core structure is formed of polycarbonate.

6. The apparatus of claim 1, wherein said framework top structure has a framework top structure upwardly protruding portion which protrudes above a support surface, and said framework top structure upwardly protruding portion has a top structure beveled peripheral surface for deflecting and withstanding the impact of vehicle tires and snow plow blades.

7. The apparatus of claim 2, wherein said framework is formed of one of cast iron and cast aluminum for strength and durability and having a weight bearing, upright framework bolt made of steel.

8. The apparatus of claim 1, additionally comprising a light passing cover structure which is one of transparent and translucent extending within said solar cell exposure port for preventing the entry of rain water and debris into said light assembly.

9. The apparatus of claim 1, wherein said at least one tubular bolt passageway is internally threaded to threadedly receive and engage said framework bolt.

10. The apparatus of claim 1, wherein said framework bolt is integral with said framework top structure.

11. The apparatus of claim 1, wherein said mounting cup additionally comprises a cup lip extending laterally from said cup side wall for resting on the mounting surface.

12. A solar powered road lamp apparatus, comprising:

a mounting cup having a cup bottom wall and a cup side wall for embedding in a recess in a mounting surface;

and a light assembly removably fitted within said mounting cup, said light assembly comprising a power source and a light source connected to said power source such that said light source, a solar cell structure connected to said power source for recharging said power source and a light assembly framework comprising a substantially opaque framework top structure extending over and covering said light source and having a solar cell exposure port above said solar cell for passing sunlight to said solar cell, and having at least one light directing channel extending generally radially outward and upwardly from said light source through said framework top structure for releasing and directing light from said light source over and across the mounting surface and toward a vehicle on the mounting surface approaching said apparatus.

13. The apparatus of claim 12, comprising two substantially diametrically opposing said light directing channels in said framework top structure for directing beams of light over the mounting surface in two directions of vehicle travel on the mounting surface.

14. The apparatus of claim 12, additionally comprising a rib structure which is one of transparent and translucent and sealingly contained within said light directing channel for preventing entry of rain water and debris while passing a beam of light from said light source out of said apparatus, and a solar cell exposure port cover structure which is one of transparent and translucent extending across said solar cell exposure port for preventing entry of rain water and debris.

15. The apparatus of claim 14, wherein said rib structure and said solar cell exposure port cover structure are both part of a core structure which is one of transparent or translucent and is located underneath said framework top structure.

16. The apparatus of claim 12, wherein said light source comprises an LED.

17. A solar powered road lamp apparatus, comprising:

a mounting cup having a cup bottom wall and a cup side wall for embedding in a recess in a mounting surface, and a fluid delivery passageway extending from a delivery passageway receiving port in the upper end of said cup side wall downwardly through said cup side wall and opening out of a delivery passageway discharge port at the lower end of said cup side wall above and substantially adjacent to said cup bottom wall;

and a light assembly removably fitted within said mounting cup, said light assembly comprising a light assembly framework having a light directing channel and a solar cell exposure port, and a power source and a light source connected to said power source such that said light source emits light through said light directing channel over the mounting surface, and a solar cell positioned beneath said solar cell exposure port and connected to said power source for recharging said power source;

such that a fluid delivered under pressure into said delivery passageway receiving port and through said delivery passageway exits from said delivery passageway discharge port and collects between said light assembly and said cup bottom wall, creating hydraulic pressure beneath said light assembly and thereby lifting said light assembly relative to said mounting cup for removal of said light assembly from said mounting cup.

18. The assembly of claim 17, wherein said delivery passageway expands in diameter at said delivery passageway discharge port.

19. The assembly of claim 17, additionally comprising a slidable seal between said light assembly and said cup side wall for containing fluid delivered through said fluid delivery passageway into said mounting cup beneath said light assembly.

20. The apparatus of claim 19, wherein said slidable seal comprises a circumferential O-ring groove extending around said light assembly and an O-ring seated in said circumferential O-ring groove and making slidable sealing contact with said cup side wall.

* * * * *